US009586717B2

(12) United States Patent
Pettersson

(10) Patent No.: US 9,586,717 B2
(45) Date of Patent: Mar. 7, 2017

(54) PACKAGING CONTAINER AND METHOD FOR ITS PRODUCTION

(71) Applicant: PACKSIZE LLC, Salt Lake City, UT (US)

(72) Inventor: Niklas Pettersson, Vasteras (SE)

(73) Assignee: PACKSIZE LLC, Salt Lake City, UT (US)

( * ) Notice: Subject to any disclaimer, the term of this patent is extended or adjusted under 35 U.S.C. 154(b) by 0 days.

(21) Appl. No.: 14/771,979

(22) PCT Filed: Feb. 18, 2014

(86) PCT No.: PCT/SE2014/050192
§ 371 (c)(1),
(2) Date: Sep. 1, 2015

(87) PCT Pub. No.: WO2014/137267
PCT Pub. Date: Sep. 12, 2014

(65) Prior Publication Data

US 2016/0009443 A1 Jan. 14, 2016

(30) Foreign Application Priority Data

Mar. 4, 2013 (SE) ..... 1350258

(51) Int. Cl.
*B65D 5/56* (2006.01)
*B31B 3/26* (2006.01)
(Continued)

(52) U.S. Cl.
CPC ..... *B65D 5/566* (2013.01); *B31B 3/26* (2013.01); *B65D 5/0245* (2013.01);
(Continued)

(58) Field of Classification Search
CPC ..... B65D 5/566; B65D 5/0245; B65D 5/28; B31B 3/26
(Continued)

(56) References Cited

U.S. PATENT DOCUMENTS 1,414,236 A * 4/1922 Walmsley ..... B65D 5/0245 229/104
2,593,895 A 4/1952 Kohl
(Continued)

FOREIGN PATENT DOCUMENTS

| | | | |
|---|---|---|---|
| DE | 8 020 235 | U | 10/1980 |
| NL | 6 608 783 | A | 12/1967 |
| WO | 2006/101443 | A1 | 9/2006 |

OTHER PUBLICATIONS

International Search Report, dated Jun. 4, 2014, from corresponding PCT application.

*Primary Examiner* — Christopher Demeree
(74) *Attorney, Agent, or Firm* — Young & Thompson

(57) ABSTRACT

A packaging container includes at least three integrally coupled panels connected by longitudinal scoring lines for forming a bottom and connecting sides of a rectangular case, which can be raised from an individual cardboard sheet; at least one end of the container is countersunk through an end panel arranged retracted inside a reinforced end zone including strips of side and bottom panel material, folded back against the bottom and side panels along a scoring line extending transversely through the bottom and side panels, wherein the end panel, via a transverse lower scoring line, is united to the folded-back strip of the bottom panel, and the end panel, in each side thereof, includes a respective tab connected with the end panel via a scoring line which extends the longitudinal scoring lines through the end zone, and the tab extends beside and parallel to an adjacent side panel of the container.

9 Claims, 3 Drawing Sheets

(51) Int. Cl.

| | |
|---|---|
| ***B65D 5/02*** | (2006.01) |
| ***B65D 5/28*** | (2006.01) |
| ***B65D 5/66*** | (2006.01) |
| ***B65D 5/68*** | (2006.01) |
| ***B65D 5/20*** | (2006.01) |

(52) U.S. Cl.
CPC ..... *B65D 5/2095* (2013.01); *B65D 5/28* (2013.01); *B65D 5/6661* (2013.01); *B65D 5/68* (2013.01)

(58) Field of Classification Search
USPC ..... 229/122.32, 122.31, 104; 206/756, 784
See application file for complete search history.

(56) References Cited

U.S. PATENT DOCUMENTS

| | | | | | |
|---|---|---|---|---|---|
| 3,055,574 | A | * | 9/1962 | Johnson | B65D 5/0245 206/424 |
| 3,160,344 | A | | 12/1964 | Bogren | |
| 3,179,325 | A | | 4/1965 | Johnson | |
| 3,227,356 | A | * | 1/1966 | Eifrid | B65D 5/0245 206/424 |
| 4,090,607 | A | * | 5/1978 | McCall | B65D 5/0245 206/424 |
| 4,396,118 | A | | 8/1983 | Watson | |
| 6,032,853 | A | | 3/2000 | Chevalier | |

* cited by examiner

Fig. 3d
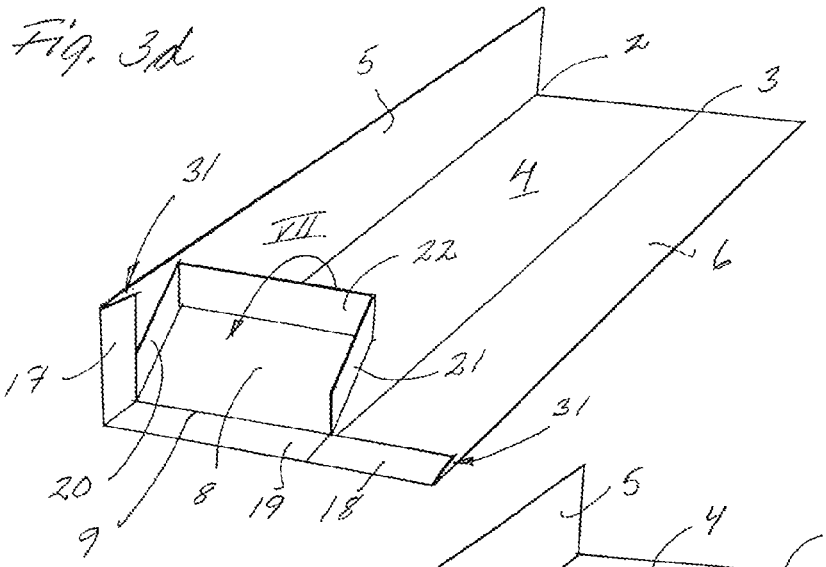
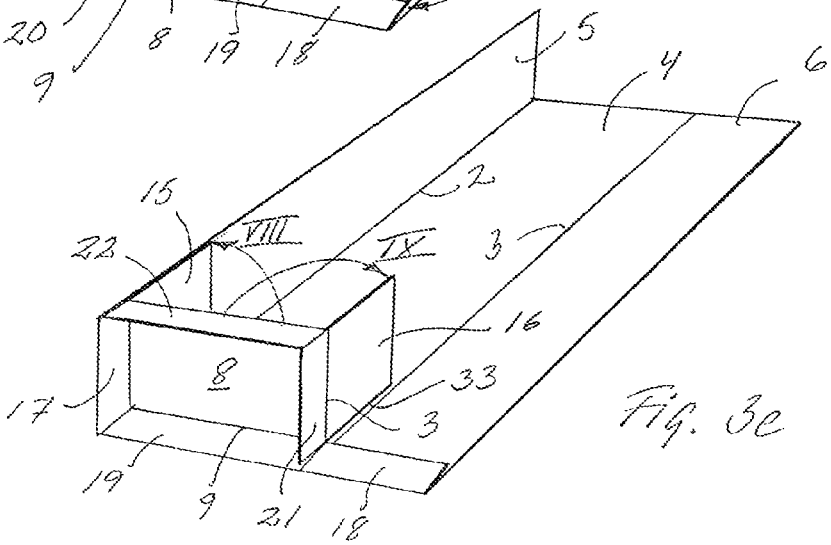
Fig. 3e
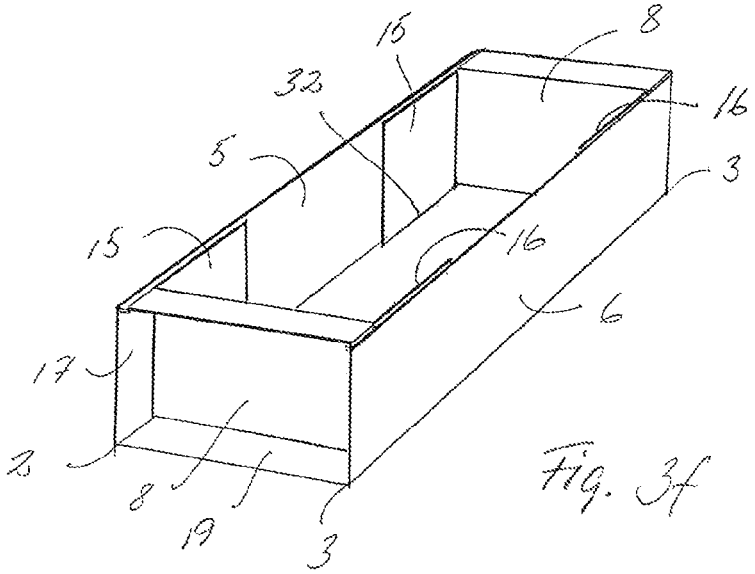
Fig. 3f

PACKAGING CONTAINER AND METHOD FOR ITS PRODUCTION

TECHNICAL FIELD OF THE INVENTION

The present invention relates to a packaging container and a method for its production. In particular, the invention relates to a box-shaped, rectangular case for packing, which can be produced from a flat sheet of corrugating board by folding along cuts and scoring lines which are applied in the flat sheet, the container, in at least one end of the same positioned countersunk, having an end panel which is retracted and protected by a reinforced end of the packaging container.

BACKGROUND AND PRIOR ART

Box-shaped cases of corrugating board having reinforced and protecting ends are utilized extensively as transportation packaging for fragile and easily damaged items and goods. The patent literature contains numerous examples of box-shaped cases manufactured from an individual flat corrugating board sheet, in which cuts and scoring lines have been applied and along which the flat sheet is foldable for the production of a rectangular container or case having a countersunk and reinforced short side or end which has a retracted end panel.

As examples, DE 80 20 235 U1 and U.S. Pat. No. 2,593,895 have containers of cardboard or corrugating board having reinforced end zones formed by folding along cuts and scoring lines which have been applied in a flat sheet of cardboard. These two represent a procedure which relies on tabs engaging slots to prevent the end panels from falling and to keep the sides of the container in the erected position.

Another procedure is represented by U.S. Pat. Nos. 4,090,607 and 6,032,853, which both rely on an adhesive or an adhesive tape to keep the sides and end panels of the container in the erected position.

Yet a procedure is represented by U.S. Pat. No. 3,160,344, which at least partly relies on an item placed inside the container to prevent the end panels from falling, or by U.S. Pat. No. 4,396,118, which relies on outer end panels which are suspended from a lid to keep retracted, inner end panels in the erected position inside the outer end panels.

WO 2006/101443 provides a box-shaped case manufactured from an individual sheet of corrugating board, wherein the end panels are arranged in a retracted way inside a reinforced end zone. This container requires neither an adhesive nor another measure to prevent the end panels from falling once the container has been closed, and relies only on a co-operation between the panels that form the closed container.

It should, however, be noted that the packaging container disclosed in WO 2006/101443 requires a "third hand" or a special tool which temporary assists in the raising of the container from the flat cardboard sheet, and the container formed in this way cannot retain its erected position and shape if it is not closed at once by means of a lid.

THE INVENTION IN BRIEF

The present invention aims at providing a packaging container of the above-described type which is self-supporting and retains its shape only as a result of a co-operation between the panels that constitute the packaging container, accordingly without requiring adhesive or other lock members to maintain the box-type structure of the packaging container.

Another object of the present invention is to provide a packaging container of this design which easily can be erected from a flat sheet of cardboard without requiring temporary assistance from a third hand or tool.

These objects are met in a packaging container comprising at least three integratedly coupled panels, which are united by longitudinal scoring lines for the formation of a bottom and connecting sides of a rectangular packaging container which is erectable from an individual sheet of cardboard. At least one end of the packaging container is countersunk through an end panel which is arranged in a retracted way inside a reinforced end zone. The reinforced end zone comprises strips of the side and bottom materials, which are folded back against the bottom and side panels along a scoring line which is applied across the bottom panel and the side panels. Via a scoring line running transverse through the bottom panel, the end panel is united to the folded-back strip of the bottom panel, in addition to which the end panel, in each one of the sides thereof, has a respective end panel tab, which end panel tabs are united to the end panel via scoring lines which coincide with the longitudinal scoring lines that unite the side panels to the bottom panel, so that the end panel tabs extend together with adjacent side panels inside the packaging container in its erected position, a respective tongue, which is connected to the end panel, extending inserted between the side panel and its appurtenant strip in each side of the packaging container.

More precisely, the tongues extend freely from opposite ends of a strip of end panel material which is united to the end panel via a transverse upper scoring line, which is running parallel to the scoring line through the bottom panel.

By said measures, the end panel is prevented from falling outward due to the tongues, which are inserted and clamped in the gaps that are formed between the side panels and their appurtenant folded-back strips. The side panels are simultaneously locked in an erected position as a result of the same engagement between the side panels and the tongues which are connected with the end panel.

By said measures, the end panel is furthermore prevented from falling inward by the support from the end panel tabs which extend along the sides of the side panels to rest against the bottom panel, inside the packaging container.

In this way, a rectangular box-shaped case is formed, which is self-supporting without requiring any additional means for retaining the erected state thereof, and which is erected from a flat sheet of cardboard or corrugating board without requiring assistance from a third hand or any tool.

A separate lid may be provided for the closure of the packaging container. The separate lid may comprise a lid panel and two lid tabs, which are united to the sides of the lid panel via longitudinal scoring lines. In one embodiment, the lid tabs are dimensioned for insertions into the gaps that are formed between the side panels and the respective appurtenant folded-back strips of side panel material. In other words, the lid tabs and the end panel tongues co-exist in said gaps in the packaging container, which is closed by means of the separate lid. Another embodiment example would be to place the lid tabs on the outside of the packaging container and secure the same by means of, for instance, belt, clips, glue, or tape.

A lid may alternatively be integrated in the packaging container, for example by a lid panel which is coupled to one of the side panels via a longitudinal scoring line. In such an embodiment, a lid tab may be united to the lid panel via a longitudinal scoring line. Said lid tab would preferably be dimensioned to be inserted into a suitable gap formed between the side panel and the appurtenant folded-back strip of side panel material in order to extend together with the tongue which extends from the end panel into the gap in question.

It should furthermore be emphasized that the described packaging container may be folded out into a flat sheet of cardboard constituting a package blank in which cuts and scoring lines are applied and along which the flat cardboard sheet can be folded for the formation of the rectangular packaging container or case.

More precisely, the cardboard sheet comprises:

longitudinal scoring lines which are running from end to end of the cardboard sheet, the longitudinal scoring lines delimiting a bottom panel between two side panels of the same size, a first transverse scoring line which is running between the longitudinal side edges of the cardboard sheet, the first transverse scoring line defining an end zone at the end of the cardboard sheet, a pair of second transverse scoring lines which are running in the end zone between the longitudinal scoring lines, the second transverse scoring lines defining an end panel between a lower scoring line and an upper scoring line, transverse, rectilinear cuts through the material formed in the end zone of the extension of the lower and upper scoring lines, from the longitudinal scoring lines to the respective side edge of the cardboard sheet, which cuts define end panel tabs and end panel tongues connected with the end panel.

It will be appreciated that said package blank results in a packaging container which requires a separate lid for its closure.

However, it should also be appreciated that a marked advantage afforded by this embodiment is that the entire width of a corrugating board web can be utilized in its entirety without cut-aways or material wastage.

Other embodiments of the package blank comprise one or more additional scoring lines extending in the longitudinal direction of the cardboard sheet to form at least one lid panel connected with an adjacent side panel, or to form a lid panel, which in its one side is connected to an adjacent side panel and in the opposite side connected to a lid tab. In the embodiments comprising a lid formed integratedly in the packaging container, the end panel tabs may advantageously be extended toward the longitudinal edge of the corrugating board web in order to, in this way, provide an extended extension together with the standing side panels of the erected packaging container.

The process of producing a box-shaped case from a package blank according to the above comprises a few manual steps, which can be carried out without the assistance of any tool or an assisting third hand:

formation of a reinforced end zone by the folding back of strips of side panel material and bottom panel material against the side and bottom panels along the first transverse scoring line, raising of the side panels by folding along the longitudinal scoring lines, raising of the end panel by folding along the lower scoring line, locking of the side panels in an erected position by insertion of the end panel tongues into the gaps which have been formed between the side panels and the folded-back strips of side panel material that are connected with the side panels, supporting of the end panel in an erected position by folding inward of the end panel tabs so that they rest against the bottom panel.

When the side panels are locked in the erected position by the engagement from the end panel tongues, the packaging container is ready for immediate use. If desired, the packaging container may alternatively be set aside for later use, and it will then from now on retain its box-like shape without additional securing means or measures.

BRIEF DESCRIPTION OF THE DRAWINGS

Embodiments of the invention will now be explained below, reference being made to the attached schematic drawings. In the drawings.

DETAILED DESCRIPTION OF PREFERRED EMBODIMENTS

Figure 1:
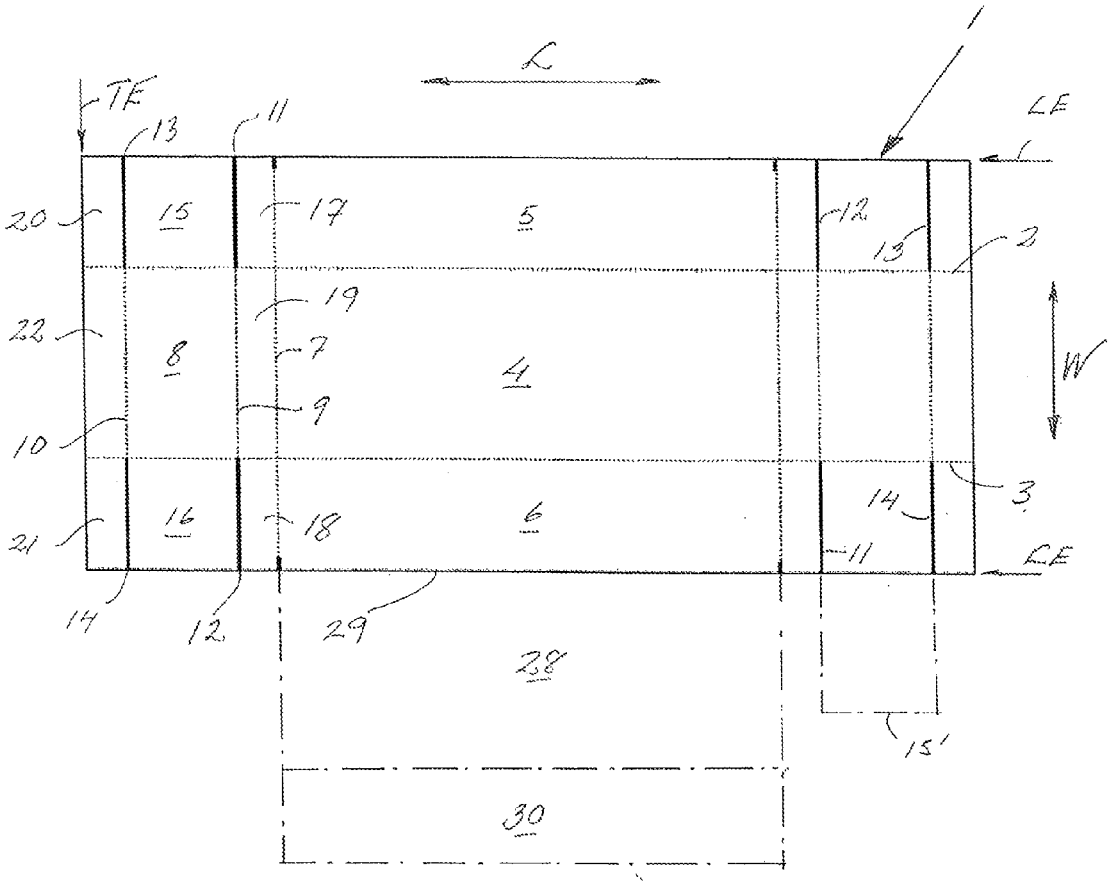
FIG. 1 illustrates the layout of cuts and scoring lines applied in a flat sheet of cardboard constituting a package blank according to a first embodiment of the invention.

The package blank of FIG. 1 is a rectangular sheet of cardboard 1 and has a longitudinal extension L and a transverse extension or width W. The cardboard sheet 1, which preferably but not necessarily is a sheet of corrugating board, comprises cuts and scoring lines applied in longitudinal and transverse directions. More precisely, two scoring lines 2 and 3 extend in parallel in the longitudinal direction of the cardboard sheet 1, the scoring lines 2 and 3 defining a bottom panel 4 and two connecting side panels 5 and 6 of the same width. The longitudinal scoring lines 2 and 3 are extended to the transverse edge TE of the cardboard sheet 1, the scoring lines 2 and 3 running through an end zone which is defined by a transverse scoring line 7. In the end zone, additional transverse scoring lines form an end panel 8 defined between a lower scoring line 9 and an upper scoring line 10.

The lower scoring line 9 is extended in the transverse direction to the respective longitudinal edge LE of the cardboard sheet 1, in the form of cuts 11 and 12 which run from the longitudinal scoring lines 2 and 3 to the respective adjacent longitudinal edge of the cardboard sheet. The upper scoring line 10 is correspondingly extended in the transverse direction to the respective longitudinal edge by means of cuts 13 and 14 which run from the longitudinal scoring lines 2 and 3 to the adjacent longitudinal edge. Between themselves, the cuts 11 and 13 form an end panel tab 15 which connects to the end panel 8 via the extension of the longitudinal scoring line 2. In a similar way, the cuts 12 and 14 form between themselves an end panel tab 16, which connects to the end panel 8 via the extension of the longitudinal scoring line 3.

Strips 17, 18 oriented in the cross-direction of side panel material and of bottom panel material 19 are, on one hand, delimited by the transverse scoring line 7, and, on the other hand, by the lower scoring line 9 and the appurtenant cuts 11 and 12. The strips 17 and 18 of side panel material connect to the bottom panel strip 19 via the longitudinal scoring lines 2 and 3, which form the lower corners of the completed case.

In the outermost end of the package blank, strips of material are separated from the cardboard sheet 1 by means of cuts 13 and 14. The strips form tongues 20, 21, which, via the longitudinal scoring lines 2 and 3, respectively, are connected with a strip 22 of end panel material. The strip 22 is in turn connected with the end panel 8 via the upper scoring line 10, whereby the tongues 20, 21, in this way, are effectively connected with the end panel 8.

In a package blank for a packaging container wherein both opposite ends are countersunk and retracted inside a protecting end zone, the ends of the package blank may be formed as mirror images of each other.

Figure 2:
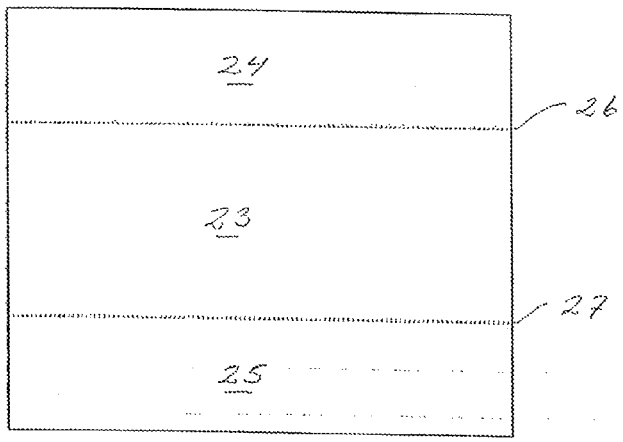
FIG. 2 shows a separate lid for a packaging container, which is made from the package blank in FIG. 1, and FIGS. 3*a*-3*f* illustrate, in partially broken-away perspective views, the consecutive steps for the formation of a packaging container from the package blank in FIG. 1.

In ways explained below, with reference to FIGS. 3*a-d*, the package blank 1 may be folded for the formation of an upwardly open container or case. A separate lid for the closure of the packaging container may be arranged in ways illustrated in FIG. 2. The lid comprises a lid panel 23 and two lid tabs 24, 25, which connect to the sides of the lid panel via longitudinal scoring lines 26 and 27. In ways illustrated in FIG. 1 by dash-dotted lines, a lid panel 28 may alternatively be integratedly formed in the packaging container and connected with a side panel via a longitudinal scoring line 29. Additional panels 30 may be foldably connected with the lid panel. In such an embodiment, there is sheet material available to form, if desired, extended end panel tabs 15', which likewise is indicated by dash-dotted lines in FIG. 1.

Figure 3A:
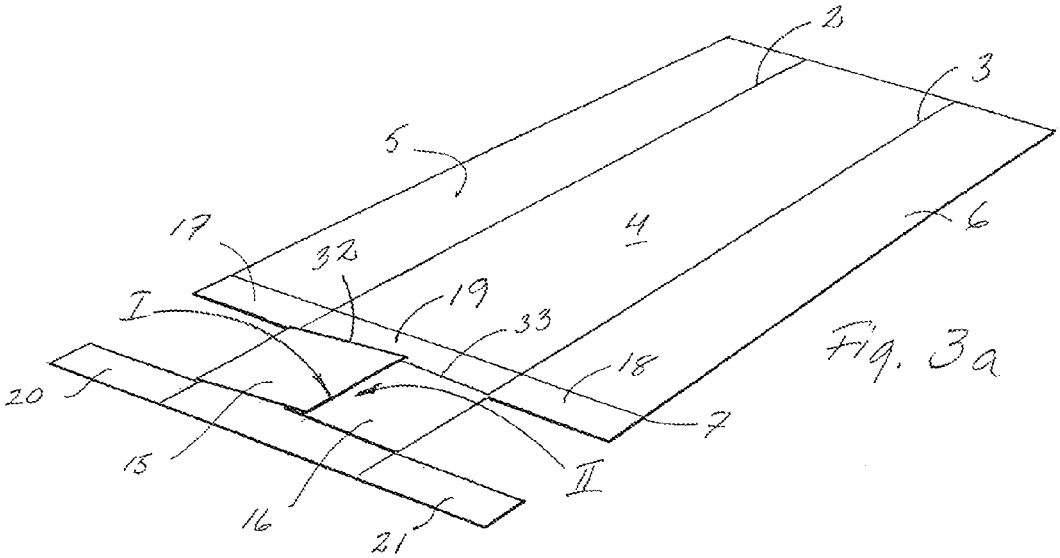

The steps to form a packaging container from the cardboard sheet 1 will be described below, reference being made to FIGS. 3*a*-3*f*, the arrows I to IX representing the folding steps in order. It should be noted that for the sake of clarity and for understanding, the drawings in FIGS. 3*c*, 3*d*, and 3*e* show only a partially completion of the packaging container. The entirely completed packaging container is however shown in FIG. 3*f*.

With reference to FIG. 3*a*, a first step in the process for the formation of a packaging container from the cardboard sheet 1 accordingly comprises a folding (see arrows I, II) of the end panel tabs 15 and 16 along the longitudinal scoring lines 2 and 3, so that the end panel tabs rest on top of each other and above the end panel 8.

Figure 3B:
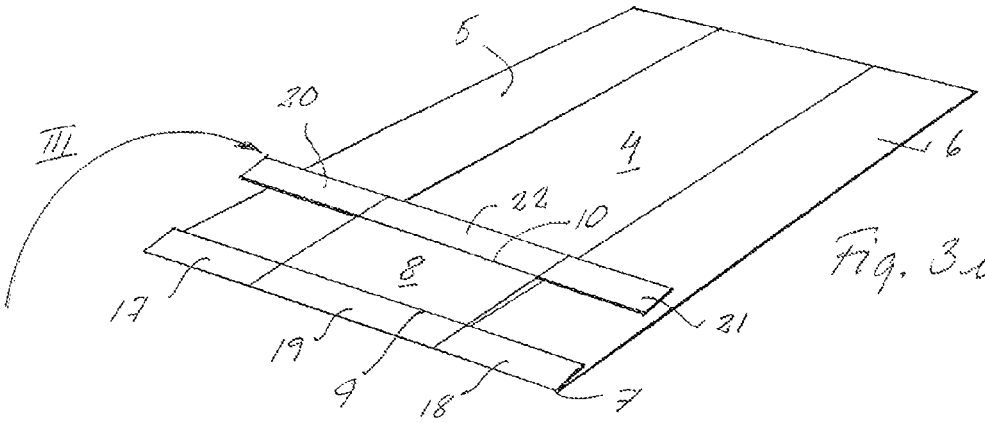
Figure 3C:
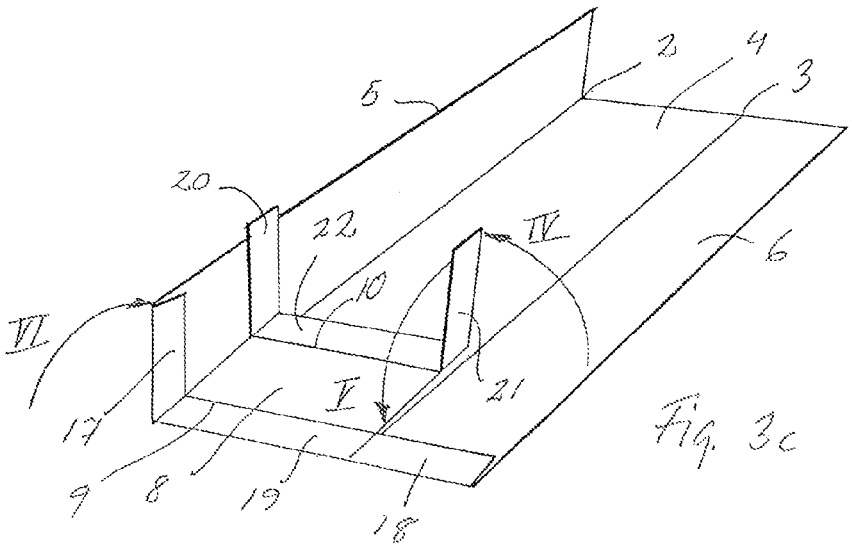

Next, the entire end zone is folded back against the side and bottom panels by folding (arrow III) along the transverse scoring line 7 to assume the position shown in FIG. 3*b*.

In the next following steps - in which the relative order is unimportant—illustrated in FIG. 3*c*, the tongues 20 and 21 are folded up along the scoring lines 2 and 3 (arrow IV), so as to, together with the strip 22, be folded against the end panel 8 along the upper scoring line 10 (arrow V), whereupon the side panels are erected by folding (arrow VI) along the longitudinal scoring lines 2 and 3.

In a finishing step shown in FIG. 3*d*—wherein one side is shown open to increase the clarity—the end panel 8 is raised by folding (arrow VII) along the lower scoring line 9, while the tongues 20, 21 simultaneously are inserted into the gaps 31 which are formed between the folded-back side panel strips 17, 18 and the appurtenant side panels 5, 6 in order to, in this way, lock the side panels in an erected position as a result of the engagement from the tongues 20, 21 in the gaps 31.

In a concluding step, see FIG. 3*e*, the end panels are prevented from falling inward by folding the end panel tabs 15 and 16 against the side panels (arrows VIII, IX) in such a way that the respective tab 15, 16 extends beside and nearly parallel to the adjacent side panel, the tabs resting with the lower edges 32, 33 thereof against the bottom panel 4 in the completed packaging container.

The invention is of course not limited to packaging containers having exactly the proportions shown here, but the invention concerns the structure of the packaging container as such and the definition of the same in the attached claims.

The invention claimed is:

1. Packaging container comprising:

at least three integratedly coupled panels, which are connected by longitudinal scoring lines (2, 3) for the formation of a bottom (4) and connecting sides (5, 6) of a rectangular case, which can be erected from an individual sheet (1) of cardboard;

wherein at least one end of the packaging container is countersunk through an end panel (8), which is arranged retracted inside a reinforced end zone, the reinforced end zone comprising strips (17, 18, 19) of side panel material and bottom panel material, which are folded back against the bottom and side panels along a scoring line (7) applied in the transverse direction through the bottom and side panels, wherein the end panel (8), via a transverse lower scoring line (9), is united to one of the strips (19) of the bottom panel material that has been folded back against the bottom panel, and wherein the end panel (8), in each one of the sides thereof, comprises a respective end panel tab (15, 16) connected with the end panel (8) via a scoring line in the extension of the longitudinal scoring lines (2, 3) through the end zone, wherein each said end panel tab (15, 16) extends beside and parallel to the adjacent side panel (5, 6) of the packaging container, and wherein respective tongues (20, 21) extend freely from each of opposite ends of a strip (22) of the end panel material, the strip (22) of the end panel material being connected to the end panel (8) via a transverse upper scoring line (10) parallel to the lower scoring line (9), each of the tongues (20, 21) being inserted between a respective said side panel (5, 6) and a respective said strip (17, 18) of the side panel material that has been folded back.

2. Packaging container according to claim 1, further comprising a separate lid having a lid panel (23) and two lid tabs (24, 25) connecting to sides of the lid panel via longitudinal scoring lines.

3. Packaging container according to claim 2, wherein the two lid tabs (24, 25) are dimensioned to be insertable into gaps (31) between the side panels (2, 3) and a respective one of the strips (17, 18) of the side panel material that has been folded back.

4. Packaging container according to claim 1, further comprising at least one additional panel (28) integratedly coupled to one or both said side panels (5, 6) via a longitudinal scoring line.

5. Packaging container according to claim 4, wherein at least one of the end panel tabs (15) is folded back against a respective one of the side panels (5, 6).

6. Method for the production of a packaging container according to claim 1, which method comprises:

folding the end panel tabs (15, 16) along the longitudinal scoring lines (2, 3) so that said end panel tabs (15, 16) rest on top of each other and on top of the end panel (8), forming a reinforced end zone by folding back, along a first transverse scoring line (7), the strips (17, 18, 19) of side and bottom panel material against the side and bottom panels (4, 5, 6), thereby forming a gap (31)

between the respective side panel (5, 6) and the folded-back strip (17, 18) of material connecting to the side panel, raising the side panels (5, 6) by folding along the longitudinal scoring lines (2, 3), raising the end panel (8) by folding along the lower scoring line (9), locking the side panels (5, 6) in an erected position by inserting the end panel tongues (20, 21) into the gaps (31), and supporting the end panel (8) in an erected position by folding the end panel tabs (15, 16) inward to rest against the bottom panel (4).

7. Method according to claim 6, wherein closure of the packaging container comprises insertion of lid tabs (24, 25), which are connected to a separate lid panel (23), into the gaps (31) which are formed between the side panels (5, 6) and the respective strips (17, 18) of side panel material that have been folded back.

8. Method according to claim 6, wherein closure of the packaging container comprises securing lid tabs (24, 25), which are suspended from a separate lid panel (23), against the outside of the side panels (5, 6).

9. Method according to claim 6, wherein closure of the packaging container comprises securing a lid tab (30), which is suspended from a lid panel (28) which is connected to one said side panel (5, 6) , to said side panel (5, 6) opposite said side panel to which the lid panel (28) is coupled.

* * * * *